US005438974A

United States Patent [19]

Maldonado

[11] Patent Number: 5,438,974

[45] Date of Patent: Aug. 8, 1995

[54] GUARDS TO PREVENT CHILDREN FROM CONTACTING STOVE CONTROLS

[76] Inventor: Lucio Maldonado, 1256 Caoba Way, Salinas, Calif. 93905

[21] Appl. No.: 203,383

[22] Filed: Mar. 1, 1994

[51] Int. Cl.[6] ..... F24C 3/12

[52] U.S. Cl. ..... 126/42; 126/211; 126/214 A

[58] Field of Search ..... 126/42, 211, 214 A

[56] References Cited

U.S. PATENT DOCUMENTS

| | | | |
|---|---|---|---|
| 1,758,960 | 5/1930 | Mendelson et al. | 126/42 |
| 2,764,968 | 10/1956 | Shuster | 126/42 |
| 4,134,386 | 1/1979 | Miguel | 126/42 |
| 4,836,181 | 6/1989 | Saga | 126/42 |
| 4,964,393 | 10/1990 | Knudsen | 126/211 |

FOREIGN PATENT DOCUMENTS 2188414 9/1987 United Kingdom .

*Primary Examiner*—Larry Jones

[57] ABSTRACT

A guard to prevent children from contacting stove controls comprising a planar sheet of material having long parallel upper and lower edges and short side edges therebetween in a rectangular configuration to form a guard plate; an attachment plate having long parallel front and rear edges of a length equal to the length of the guard plate, the front edge of the attachment plate being formed integrally with the lower edge of the guard plate and forming an obtuse angle whereby when the attachment plate is horizontal, the upper edge of the guard plate extends outwardly from the front edge of the attachment plate; and a pair of triangular side plates, the triangular side plates having a long vertical rearward edge, and a short upper horizontal edge and a connecting hypotenuse edge therebetween, the hypotenuse edge being formed integrally with the side edges of the guard plate and extending rearwardly at about 90 degrees, the ends of the side plates remote from their short edges being parallel with the short edges.

1 Claim, 3 Drawing Sheets

GUARDS TO PREVENT CHILDREN FROM CONTACTING STOVE CONTROLS

BACKGROUND OF THE INVENTION

1. Field of the Invention

The present invention relates to guards to prevent children from contacting stove controls and more particularly pertains to preventing children from the dangers associated with improper contact with controls for stoves.

2. Description of the Prior Art

The use of oven and stove guards is known in the prior art. More specifically, oven and stove guards heretofore devised and utilized for the purpose of precluding access to ovens and stoves by children are known to consist basically of familiar, expected, and obvious structural configurations, notwithstanding the myriad of designs encompassed by the crowded prior art which has been developed for the fulfillment of countless objectives and requirements.

The prior art discloses a large number of oven and stove guards. By way of example, U.S. Pat. No. 4,157,705 to Caan discloses a range guard.

U.S. Pat. No. 4,300,524 to Elsasser discloses a safety device for child-proof gas stove.

U.S. Pat. No. 4,517,955 to Ehrlich discloses a stove safety guard.

U.S. Pat. No. 4,964,393 to Knudsen discloses a protective shield for stove.

Lastly, U.S. Pat. No. Des. 301,008 to Williams discloses a child resistant stove guard.

In this respect, guards to prevent children from contacting stove controls according to the present invention substantially depart from the conventional concepts and designs of the prior art, and in doing so provide an apparatus primarily developed for the purpose of preventing children from the dangers associated with improper contact with controls for stoves.

Therefore, it can be appreciated that there exists a continuing need for new and improved guards to prevent children from contacting stove controls which can be used for preventing children from the dangers associated with improper contact with controls for stoves. In this regard, the present invention substantially fulfills this need.

SUMMARY OF THE INVENTION

In view of the foregoing disadvantages inherent in the known types of oven and stove guards now present in the prior art, the present invention provides improved guards to prevent children from contacting stove controls. As such, the general purpose of the present invention, which will be described subsequently in greater detail, is to provide new and improved guards to prevent children from contacting stove controls and methods which have all the advantages of the prior art and none of the disadvantages.

To attain this, the present invention essentially comprises a new and improved guard to prevent children from contacting stove controls comprising, in combination, a planar sheet of metal having long parallel upper and lower edges and short side edges therebetween in a rectangular configuration to form a guard plate; an attachment plate having long parallel front and rear edges of a length equal to the length of the guard plate, the front edge of the attachment plate being formed integrally with the lower edge of the guard plate and forming an obtuse angle of about 120 degrees whereby when the attachment plate is horizontal, the upper edge of the guard plate extends outwardly from the front edge of the attachment plate; a pair of triangular side plates, the triangular side plates having a long vertical rearward edge, and a short upper horizontal edge and a connecting hypotenuse edge therebetween, the hypotenuse edge being formed integrally with the side edges of the guard plate and extending rearwardly at about 90 degrees, the ends of the side plates remote from their short edges being parallel with the short edges; the upper edge of the guard plate and the horizontal and vertical edges of the side plates being rolled over to form strengthened peripheral edges for strength and safety to preclude cuts from sharp edges; a plurality of equally spaced holes located along the length of the attachment plate; and a plurality of sheet metal screws positionable through the holes of the attachment plate for securement to a lower horizontal surface of an oven above its door to thereby shield the controls of the oven and stove thereabove from inadvertent contact by a child but to allow access thereto from above by an adult.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved guards to prevent children from contacting stove controls which have all the advantages of the prior art oven and stove guards and none of the disadvantages.

It is another object of the present invention to provide new and improved guards to prevent children from contacting stove controls which may be easily and efficiently manufactured and marketed.

It is a further object of the present invention to provide new and improved guards to prevent children from contacting stove controls which are of a durable and reliable construction.

An even further object of the present invention is to provide new and improved guards to prevent children from contacting stove controls which are susceptible of a low cost of manufacture with regard to both materials and labor, and which accordingly are then susceptible of low prices of sale to the consuming public, thereby making such guards to prevent children from contacting stove controls economically available to the buying public.

Still yet another object of the present invention is to provide new and improved guards to prevent children from contacting stove controls which provide in the apparatuses and methods of the prior art some of the advantages thereof, while simultaneously overcoming some of the disadvantages normally associated therewith.

Even still another object of the present invention is to prevent children from the dangers associated with improper contact with controls for stoves.

Lastly, it is an object of the present invention to provide a guard to prevent children from contacting stove controls comprising a planar sheet of material having long parallel upper and lower edges and short side edges therebetween in a rectangular configuration to form a guard plate; an attachment plate having long parallel front and rear edges of a length equal to the length of the guard plate, the front edge of the attachment plate being formed integrally with the lower edge of the guard plate and forming an obtuse angle whereby when the attachment plate is horizontal, the upper edge of the guard plate extends outwardly from the front edge of the attachment plate; and a pair of triangular side plates, the triangular side plates having a long vertical rearward edge, and a short upper horizontal edge and a connecting hypotenuse edge therebetween, the hypotenuse edge being formed integrally with the side edges of the guard plate and extending rearwardly at about 90 degrees; the ends of the side plates remote from their short edges being parallel with the short edges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
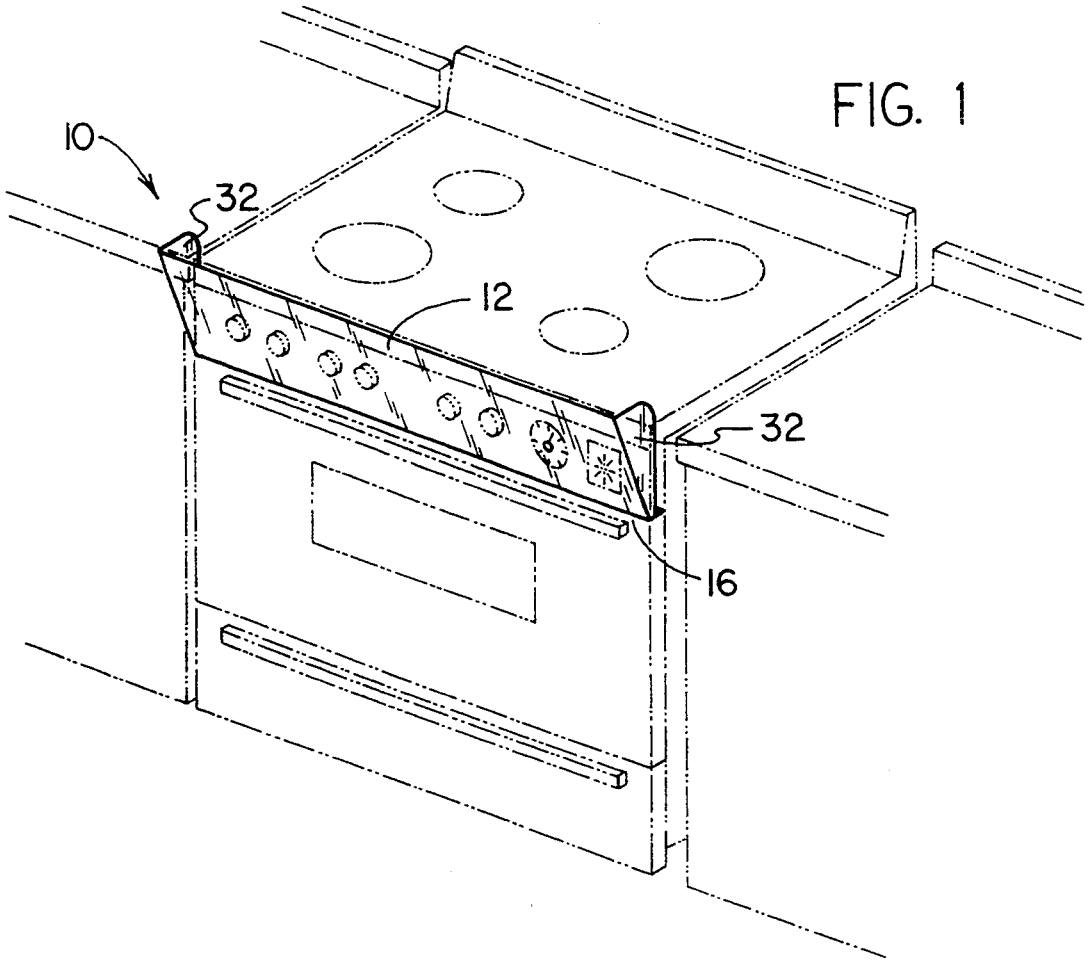
FIG. 1 is a perspective illustration of the preferred embodiment of the new and improved guards to prevent children from contacting stove controls constructed in accordance with the principles of the present invention.
Figure 2:
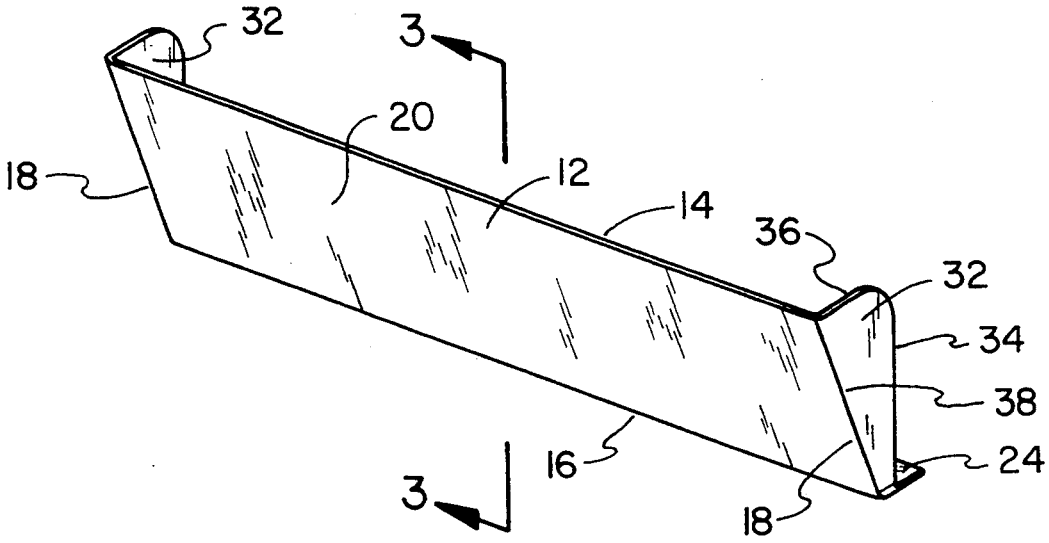
FIG. 2 is a perspective illustration of the device shown in FIG. 1 but illustrated away from the stove to be protected.
Figure 3:
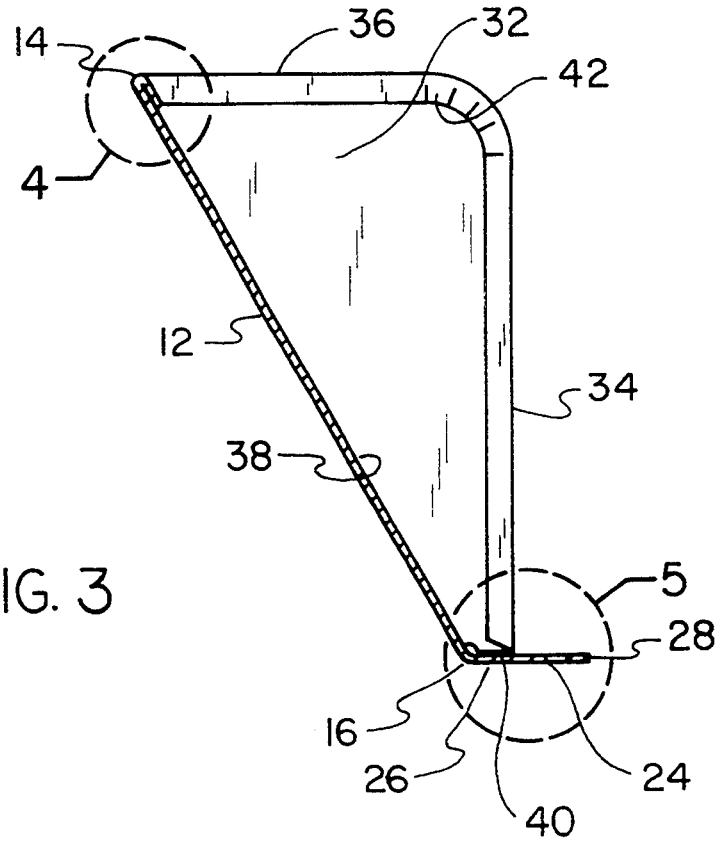
FIG. 3 is a side elevational view of the device of FIG. 1 but constructed in accordance with an alternate embodiment of the invention.
Figure 4:
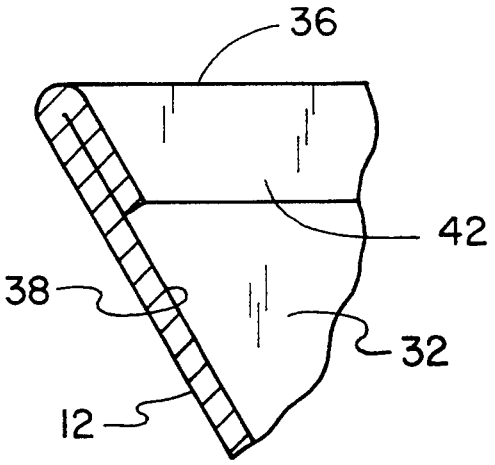
FIG. 4 is an enlarged sectional view of a portion of the device of the prior Figures taken at circle 4 of FIG. 3.
Figure 5:
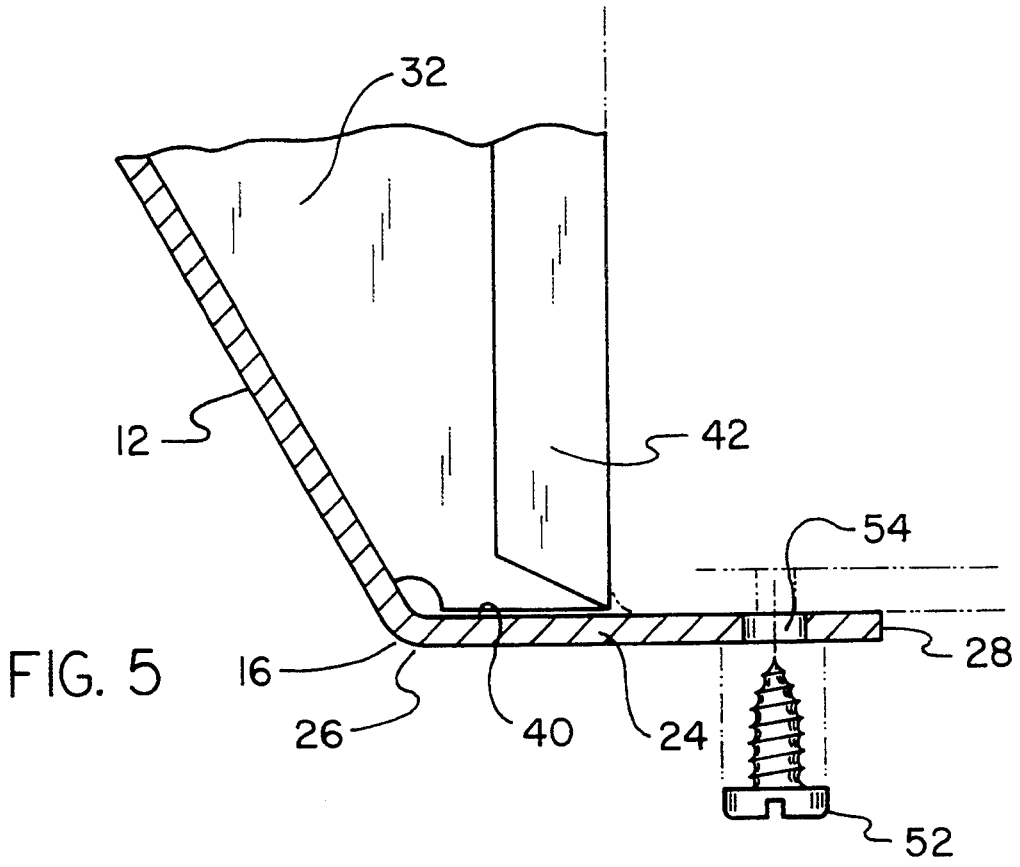
FIG. 5 is an enlarged sectional view of a portion of the device of the prior Figures taken at circle 5 of FIG. 3.
Figure 6:
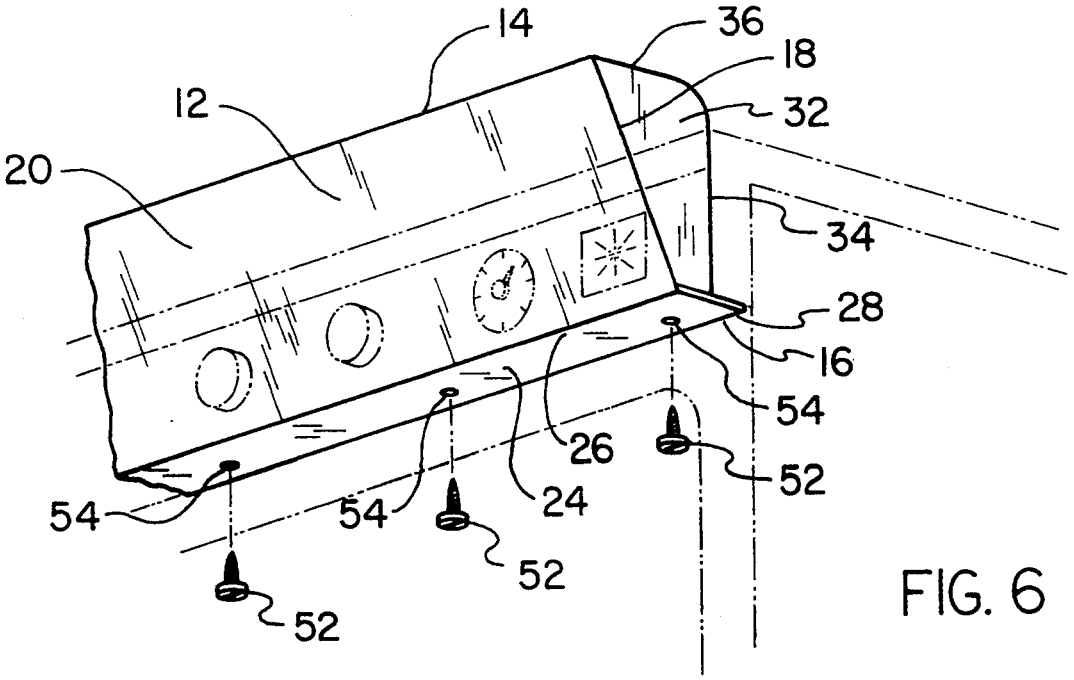
FIG. 6 is a perspective illustration of the device of the prior Figures illustrating its attachment to the stove.

With reference now to the drawings, and in particular to FIGS. 1 through 6 thereof, the preferred embodiment of the new and improved guards to prevent children from contacting stove controls embodying the principles and concepts of the present invention and generally designated by the reference numeral 10 will be described.

Specifically, the present invention, the new and improved guards to prevent children from contacting stove controls, may be construed as a device comprised of a plurality of individual components. Such components are individually constructed and correlated one with respect to the other to attain the desired objectives. Such individual components include a guard plate, an attachment plate, side plates, rolled edges, holes and screws.

More specifically, the central component of the device 10 is a sheet 12 of material, preferably sheet metal, of a planar construction. Such sheet of material has a long upper edge 14 and a long lower edge 16. Such long edges are parallel to each other. The sheet of material also has short side edges 18. The short side edges couple the long parallel upper and lower edges to form a rectangular configuration. Such rectangular sheet of material constitutes the guard plate 20. The purpose of the guard plate will be understood from a description of the related components hereinafter.

Next provided is an attachment plate 24. The attachment plate has a long front edge 26 and a long rear edge 28. Such long edges are parallel with respect to each other and of a length essentially equal to the length of the long edges of the guard plate. The front edge of the attachment plate is formed integrally with the lower edge of the guard plate. Such coupling effects an obtuse angle of about 120 degrees between the guard plate and the attachment plate. Such angle exists at all times. When, however, the attachment plate is secured for operation and use in a horizontal orientation, then the upper edge of the guard plate extends outwardly from the front edge of the attachment plate to form an opening thereabove.

A pair of triangular side plates 32 are next provided. Such triangular side plates have a long vertical rearward edge 34 and a short upper horizontal edge 36. Such vertical and horizontal edges are at essentially right angles, 90 degrees, with respect to each other. They are coupled by a long hypotenuse edge 38 therebetween. The hypotenuse edge is formed integrally with the side edges of the guard plate. They extend rearwardly at about 90 degrees from the guard plate. The ends 40 of the side plates remote from the short edges 36 are parallel with the short edges 36.

Greater strength and safety is provided to the device 10 of the present invention by employing rolled-over edges 42. More specifically, the upper edge of the guard plate and the horizontal and vertical edges of the side plates have their free ends rolled over to form strengthened peripheral edges. Note in particular FIG. 4. Such rolled-over edges add strength not only to the edges but to the device as a whole. They also provide additional safety to the device 10 by minimizing sharp edges to preclude cuts to users or other persons making contact therewith.

Next provided are a plurality of equally spaced holes 48. Such holes are located along the length of the attachment plate.

The last element of the device is a plurality of sheet metal screws 52. Such screws are positionable upwardly through the holes 54 of the attachment plate. Their function is to secure the attachment plate, and consequently the entire device, to a stove adjacent to the control knobs for attaining the desired objectives. Such securement is to a lower horizontal surface of an oven, preferably above its door. Note FIGS. 1, 5 and 6. So positioned, the device will shield the controls of the oven and stove thereabove from inadvertent contact by a child or other person. However, because of the outward angling of the shield plate, access to such controls will be capable from above as by an adult while still precluding contact by a child.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved guard to prevent children from contacting stove controls comprising, in combination:

a planar sheet of metal having long parallel upper and lower edges and short side edges therebetween in a rectangular configuration to form a guard plate;

an attachment plate having long parallel front and rear edges of a length equal to the length of the guard plate, the front edge of the attachment plate being formed integrally with the lower edge of the guard plate and forming an obtuse angle of about 120 degrees whereby when the attachment plate is horizontal, the upper edge of the guard plate extends outwardly from the front edge of the attachment plate and the stove controls when coupled with respect thereto while the lower edge of the guard plate is adjacent to the front edge of the attachment plate and the stove controls when coupled with respect thereto;

a pair of triangular side plates, the triangular side plates having a long vertical rearward edge, and a short upper horizontal edge and a connecting hypotenuse edge therebetween, the hypotenuse edge being formed integrally with the side edges of the guard plate and extending rearwardly at about 90 degrees, the ends of the side plates remote from their short edges being parallel with the short edges;

the upper edge of the guard plate and the horizontal and vertical edges of the side plates being rolled over to form strengthened peripheral edges for strength and safety to preclude cuts from sharp edges;

a plurality of equally spaced holes located along the length of the attachment plate; and a plurality of sheet metal screws positionable through the holes of the attachment plate for securement to a lower horizontal surface of an oven above its door to thereby shield the controls of the oven and stove thereabove from inadvertent contact by a child but to allow access thereto from above by an adult.

* * * * *